US007431153B2

(12) United States Patent
Li Vigni et al.

(10) Patent No.: US 7,431,153 B2
(45) Date of Patent: Oct. 7, 2008

(54) PACKAGE OF TOBACCO ITEMS WITH A FOLDABLE BOTTOM SHELL

(75) Inventors: Angelo Li Vigni, Bologna (IT); Fiorenzo Draghetti, Medicina (IT)

(73) Assignee: G.D Societa' per Azioni, Bologna (IT)

( * ) Notice: Subject to any disclaimer, the term of this patent is extended or adjusted under 35 U.S.C. 154(b) by 276 days.

(21) Appl. No.: 10/505,619

(22) PCT Filed: Feb. 14, 2003

(86) PCT No.: PCT/EP03/50017

§ 371 (c)(1),
(2), (4) Date: Mar. 3, 2005

(87) PCT Pub. No.: WO03/070602

PCT Pub. Date: Aug. 28, 2003

(65) Prior Publication Data

US 2005/0150787 A1 Jul. 14, 2005

(30) Foreign Application Priority Data

Feb. 21, 2002 (IT) ..... BO2002A0085

(51) Int. Cl.
*B65D 85/12* (2006.01)

(52) U.S. Cl. ..... 206/271; 206/259; 206/273

(58) Field of Classification Search ..... 206/248, 206/259, 258, 260, 261, 265, 268, 271, 273, 206/497, 242; 131/231

See application file for complete search history.

(56) References Cited

U.S. PATENT DOCUMENTS

| | | | | | |
|---|---|---|---|---|---|
| 2,680,537 | A | * | 6/1954 | Dzialdowski | 220/275 |
| 2,999,584 | A | * | 9/1961 | Gillespie | 206/246 |
| 3,018,877 | A | * | 1/1962 | Posavic | 206/246 |
| 3,058,581 | A | * | 10/1962 | Keating | 206/256 |
| 4,119,196 | A | * | 10/1978 | Flaherty | 206/271 |
| 4,961,496 | A | | 10/1990 | Focke et al. | |
| 5,682,986 | A | | 11/1997 | Cobler | |
| 5,799,781 | A | * | 9/1998 | Arthur | 206/246 |
| 5,996,588 | A | * | 12/1999 | Abrines Amer | 131/231 |
| 6,112,892 | A | * | 9/2000 | Thibaud | 206/242 |
| 7,000,761 | B2 | * | 2/2006 | Swart et al. | 206/271 |

FOREIGN PATENT DOCUMENTS

| | | |
|---|---|---|
| CH | 690 005 | 3/2000 |
| DE | 78 23 117 | 3/1979 |
| DE | 298 16 112 | 7/1999 |

* cited by examiner

*Primary Examiner*—Mickey Yu
*Assistant Examiner*—Melissa L Lalli
(74) *Attorney, Agent, or Firm*—Marshall, Gerstein & Borun LLP

(57) ABSTRACT

A package (1) of tobacco items, of which form part a packet (2) of tobacco items, which opens at the top, is substantially parallelepiped-shaped, and houses a group (3) of tobacco items; and a foldable protective member (4), which assumes a closed configuration, in which it is flat and rectangular, and an open configuration, in which it is tubular to house a portion of the packet (2) of tobacco items with no clearance; the protective member (4) being folded into the closed configuration and attached removably to the packet (2) of tobacco items.

16 Claims, 3 Drawing Sheets

PACKAGE OF TOBACCO ITEMS WITH A FOLDABLE BOTTOM SHELL

CROSS-REFERENCE TO RELATED APPLICATION

This is the U.S. national phase application of International Application No. PCT/EP03/50017, filed 14 Feb. 2003, which claims the benefit of Italian patent application number BO2002A000085, filed Feb. 21, 2002.

The present invention relates to a package of tobacco items.

In the following description, reference is made, for the sake of simplicity and purely by way of a non-limiting example, to packages of cigarettes.

A package of cigarettes is normally defined by a packet of cigarettes, which opens at the top, is substantially parallelepiped-shaped, houses a group of cigarettes, and may be, for example, a so-called "soft" or so-called "rigid, hinged-lid" type.

According to the results of market research, some consumers are particularly attached to a given packet design, whereas others would appreciate some variation. Currently marketed packets, however, both "soft" and "rigid", are not versatile enough to meet the demands of consumers as a whole.

Both "soft" and "rigid" packets have also been found to be of relatively poor wear resistance, particularly when used for a fairly prolonged period of time (i.e. over two days), and so not only fail to provide for adequately protecting the remaining cigarettes, but also result in tobacco spillage.

To eliminate the above drawback, it has been proposed to use thicker, and therefore stronger, than normal packing material—which solution, however, has been unsuccessful with consumers, with whom packets made of thicker than normal material have proved unpopular. Moreover, using thicker than normal packing material poses problems on existing, and particularly older, packing machines, which were not designed to operate with such material.

DE7824117 discloses a package of tobacco items comprising a parallelepiped-shaped packet of tobacco items, which opens at the top and houses a group of tobacco items, and a tubular parallelepiped-shaped paper sleeve which houses permanently a bottom portion of the packet of tobacco items with substantially no clearance.

It is an object of the present invention to provide a package of tobacco items designed to eliminate the aforementioned drawbacks, and which, in particular, is cheap and easy to produce.

According to the present invention, there is provided a package of tobacco items as recited by claim 1.

A number of non-limiting embodiments of the present invention will be described by way of example with reference to the accompanying drawings, in which.

BEST MODE FOR CARRYING OUT THE INVENTION

Figure 1:
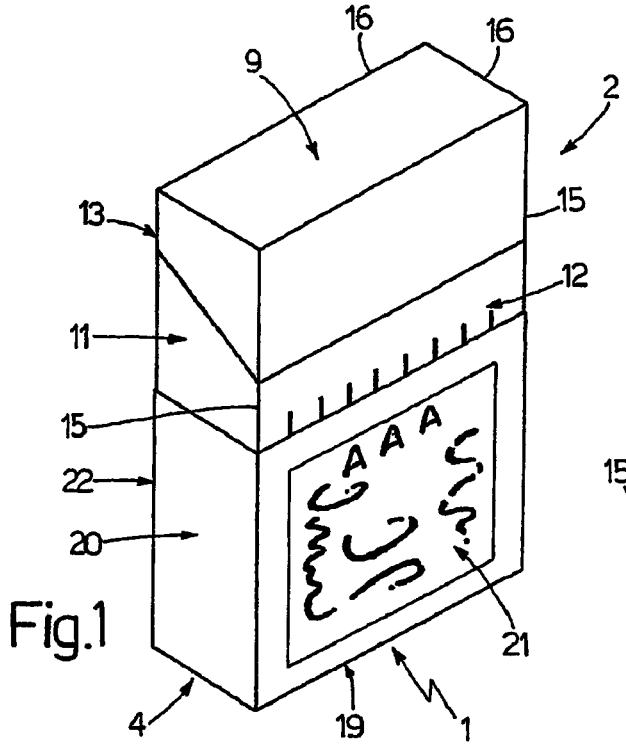
FIG. 1 shows a front view in perspective of a package of cigarettes in accordance with the present invention and comprising a packet of cigarettes and a bottom shell.

Number 1 in FIG. 1 indicates as a whole a package of cigarettes comprising a rigid packet 2 of cigarettes containing an orderly group 3 of cigarettes (FIG. 3); and a foldable protective element 4, in particular a foldable bottom shell 4. Bottom shell 4 may assume a closed configuration (FIG. 3) in which it is flat; and an open configuration (FIGS. 1 and 2) in which it is box-shaped to house a bottom portion of packet 2 with substantially no clearance.

Figure 2:
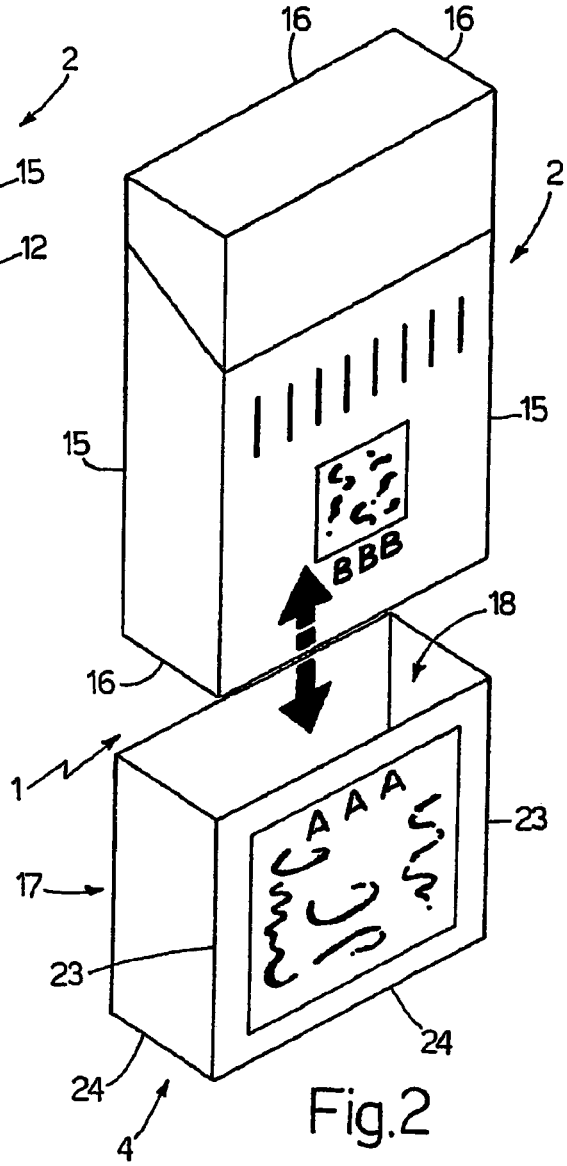
FIG. 2 shows an exploded front view in perspective of the FIG. 1 package of cigarettes.

When package 1 of cigarettes is produced, bottom shell 4 is folded into the closed configuration and attached removably to packet 2; and, in use, the user detaches bottom shell 4 from packet 2, unfolds bottom shell 4 into the open configuration, and inserts a bottom portion of packet 2 inside bottom shell 4, as shown in FIG. 2.

Bottom shell 4 obviously provides for protecting packet 2 against wear, so as to adequately protect the cigarettes inside packet 2 at all times, and also prevent tobacco spillage from the bottom portion of packet 2. Moreover, use of bottom shell 4 to strengthen packet 2 is optional, and, if necessary, bottom shell 4 may also be used as a makeshift ashtray.

Packet 2 comprises a cup-shaped bottom container 5 having an open top end 6; and a cup-shaped top lid 7 hinged to container 5 along a hinge to rotate, with respect to container 5, between an open position (FIG. 3) and a closed position (FIG. 1) opening and closing end 6 respectively.

When closed, lid 7 imparts to packet 2 a rectangular parallelepiped shape defined by a lateral wall 8, and by two flat, identical, respectively top and bottom, end walls 9 and 10 facing and parallel to each other and bounding lateral surface 8.

Lateral surface 8 comprises two flat, parallel, facing minor lateral walls 11, and two flat, facing major lateral walls 12 and 13 crosswise to minor lateral walls 11. More specifically, one major lateral wall 12 defines a front wall of packet 2, and the other major lateral wall 13 defines a rear wall of packet 2.

Packet 2 also comprises a collar 14, which is folded into a U and connected (gummed) inside cup-shaped container 5, so as to project partly outwards of end 6 and engage a corresponding inner surface of lid 7 when lid 7 is in said closed position (FIG. 1).

Four longitudinal edges 15 are defined between minor lateral walls 11 and major lateral walls 12 and 13; and eight transverse edges 16 are defined between end walls 9 and 10 and lateral walls 11, 12 and 13, are crosswise to longitudinal edges 15, and are divided into major transverse edges 16 (bounding major lateral walls 12 and 13) and minor transverse edges 16 (bounding minor lateral walls 11).

In the open configuration, bottom shell 4 is in the form of a rectangular parallelepiped-shaped box, and comprises a lateral surface 17 bounded at the top by an open end 18, and at the bottom by a bottom end wall 19. Lateral surface 17 comprises two flat, parallel, facing minor lateral walls 20, and two flat, facing major lateral walls 21 and 22 crosswise to minor lateral walls 20. More specifically, one major lateral wall 21 defines a front wall of bottom shell 4, and the other major lateral wall 22 defines a rear wall of bottom shell 4.

Four longitudinal edges 23 are defined between minor lateral walls 20 and major lateral walls 21 and 22; and four transverse edges 24 are defined between end wall 19 and lateral walls 20, 21 and 22, are crosswise to longitudinal edges 23, and are divided into major transverse edges 24 (bounding major lateral walls 21 and 22) and minor transverse edges 24 (bounding minor lateral walls 20).

In the open configuration, bottom shell 4 is preferably the same shape as packet 2, so that longitudinal edges 23 and transverse edges 24 of bottom shell 4 in the open configuration are substantially the same shape as longitudinal edges 15 and transverse edges 16 of packet 2.

In one possible embodiment not shown, packet 2 and bottom shell 4 in the open configuration both have rounded or beveled longitudinal edges 15 and 23 respectively.

In a further embodiment not shown, at least one lateral wall 11, 12 or 13 of packet 2 has at least one outwardly convex half-profile, is connected to at least one adjacent lateral wall 12, 13 or 11 along a respective sharp longitudinal edge 15, and subtends with said adjacent lateral wall 12, 13 or 11 a respective substantially obtuse dihedral angle, so that the respective longitudinal edge 15 is other than square.

Each major lateral wall 21, 22 of bottom shell 4 is substantially the same width as and smaller in height than major lateral walls 12 and 13 of packet 2; each minor lateral wall 20 of the bottom shell is substantially the same width as and smaller in height than minor lateral walls 11 of packet 2; and bottom end wall 19 of bottom shell 4 is substantially the same size as bottom end wall 10 of packet 2.

As shown in FIGS. 4 to 7, bottom end wall 19 of bottom shell 4 is defined by two panels 25 and 26, each connected to a respective major lateral wall 21 or 22 of the bottom shell along a respective major transverse edge 24; and by two panels 27 and 28, each of which is connected to a respective minor lateral wall 20 and to a respective major lateral wall 21 or 22 of the bottom shell along respective transverse edges 24. Panels 27 and 28 are located below panels 25 and 26, so that panels 25 and 26 rest on panels 27 and 28 when bottom shell 4 is in the open configuration. As such, bottom wall 19 of bottom shell 4 can fold inwards but not outwards of bottom shell 4, and so limits downward slide of packet 2 inside bottom shell 4.

Panels 25 and 26 are substantially rectangular, and panels 27 and 28 substantially triangular (more specifically, with a truncated apex). Panels 25 and 26 are smaller than bottom end wall 19 of bottom shell 4, and comprise respective complementary-shaped appendixes 29 and 30, so that, when bottom shell 4 is in the open configuration, appendixes 29 of panel 25 rest on panel 26, and appendixes 30 of panel 26 rest on panel 25. The shape of appendixes 29 and 30 is designed to further prevent bottom wall 19 of bottom shell 4 from folding outwards of bottom shell 4, and so further enable bottom wall 19 to limit downward slide of packet 2 inside bottom shell 4. More specifically, panel 25 comprises a single central appendix 29, and panel 26 comprises two appendixes 30 on either side of appendix 29.

Figure 9:
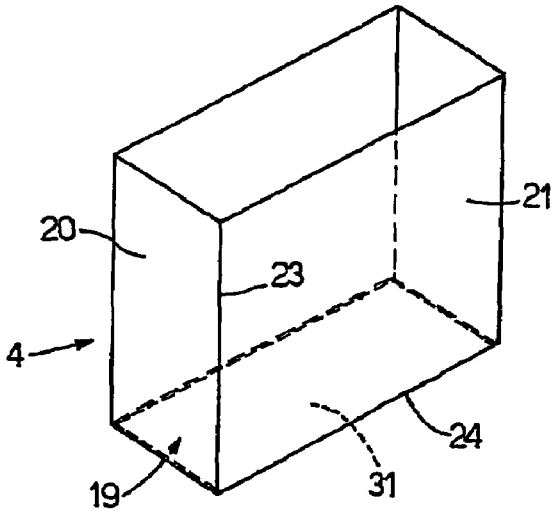
FIG. 9 shows a view in perspective of a further embodiment of the bottom shell of the FIG. 1 package of cigarettes.
Figure 5:
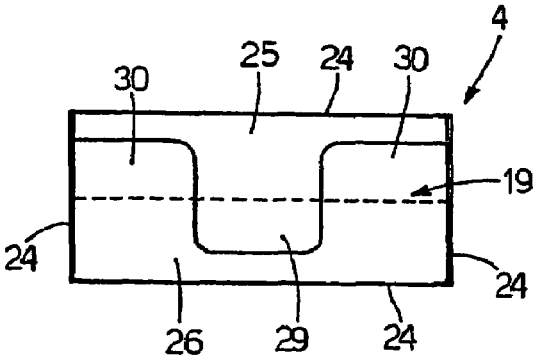
FIG. 5 shows a topside view of a bottom wall of the bottom shell in FIG. 4.
Figure 6:
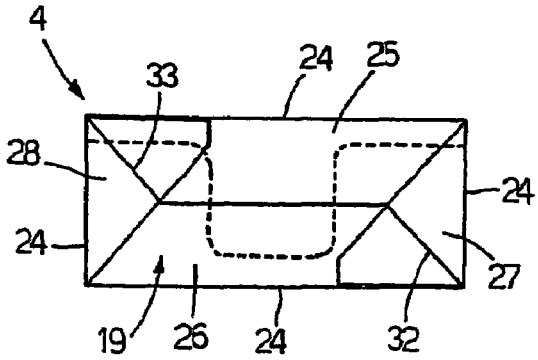
FIG. 6 shows an underside view of a bottom wall of the bottom shell in FIG. 4.

In a further embodiment (FIG. 9), bottom end wall 19 of bottom shell 4 is defined by a single panel 31 connected to front wall 21 only of bottom shell 4 along a major transverse edge 24. Preferably, panel 31 comprises a tongue (not shown), and rear wall 22 of bottom shell 44 comprises a slit (not shown) for receiving the tongue to fix panel 31 to rear wall 22.

Figure 7:
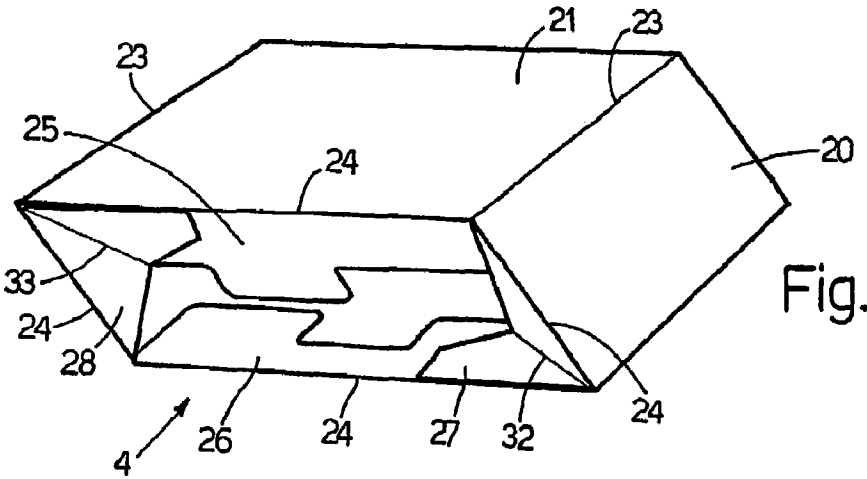
FIG. 7 shows a view in perspective of the FIG. 4 bottom shell in an intermediate configuration between a folded configuration and an open configuration.

As shown in FIG. 7, to switch from the closed to the open configuration, minor lateral walls 20 of bottom shell 4 are rotated, with respect to major lateral walls 21 and 22 of bottom shell 4, about longitudinal edges 23; panels 25 and 26 are rotated, with respect to major lateral walls 21 and 22 of bottom shell 4, about transverse edges 24; and panels 27 and 28 are rotated, with respect to major lateral walls 21 and 22 and minor lateral walls 20 of bottom shell 4, about transverse edges 24. To enable panels 27 and 28 to fold up when bottom shell 4 is in the closed configuration, each panel 27, 28 has a preformed fold line 32, 33, which extends across the whole of panel 27, 28, and originates at the intersection of the relative major transverse edge 24 and relative minor transverse edge 24.

Figure 3:
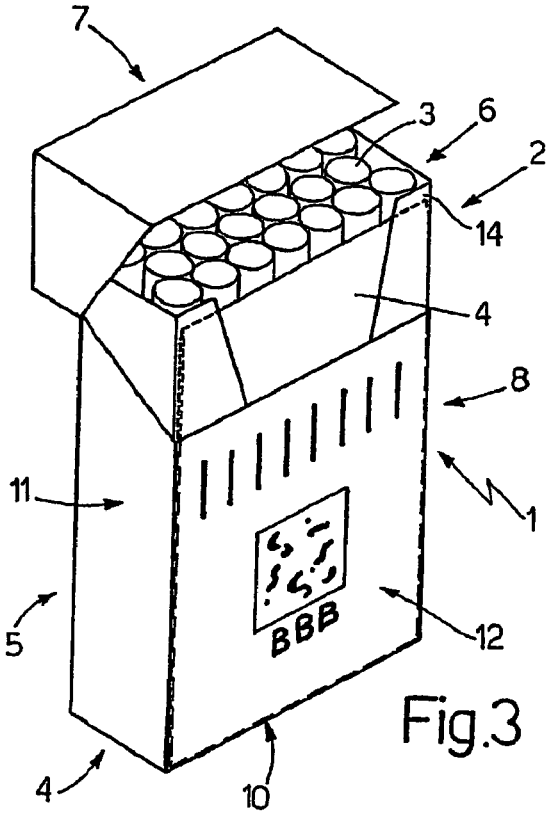
FIG. 3 shows a front view in perspective of the FIG. 1 package of cigarettes with the bottom shell folded and inserted inside the packet of cigarettes.
Figure 4:
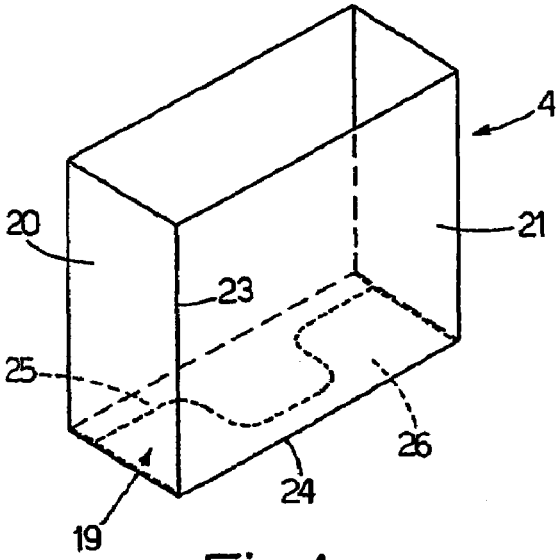
FIG. 4 shows a view in perspective of the bottom shell of the FIG. 1 package of cigarettes.

As shown in FIG. 3, bottom shell 4 in the closed configuration is inserted inside packet 2, at front wall 12 of packet 2, between group 3 of cigarettes and collar 14. In an alternative embodiment not shown, bottom shell 4 in the closed configuration is placed on the outside of a major lateral wall 12 or 13 of packet 2, and is held in position by a known transparent overwrapping (not shown) applied about packet 2. Preferably, each major lateral wall 21, 22 of bottom shell 4 is of a height smaller than (in particular, substantially equal to) the width of major lateral walls 12 and 13 of packet 2, so that bottom shell 4 in the closed configuration is smaller than (in particular, substantially the same size as) packet 2, and can so be inserted inside packet 2.

Figure 8:
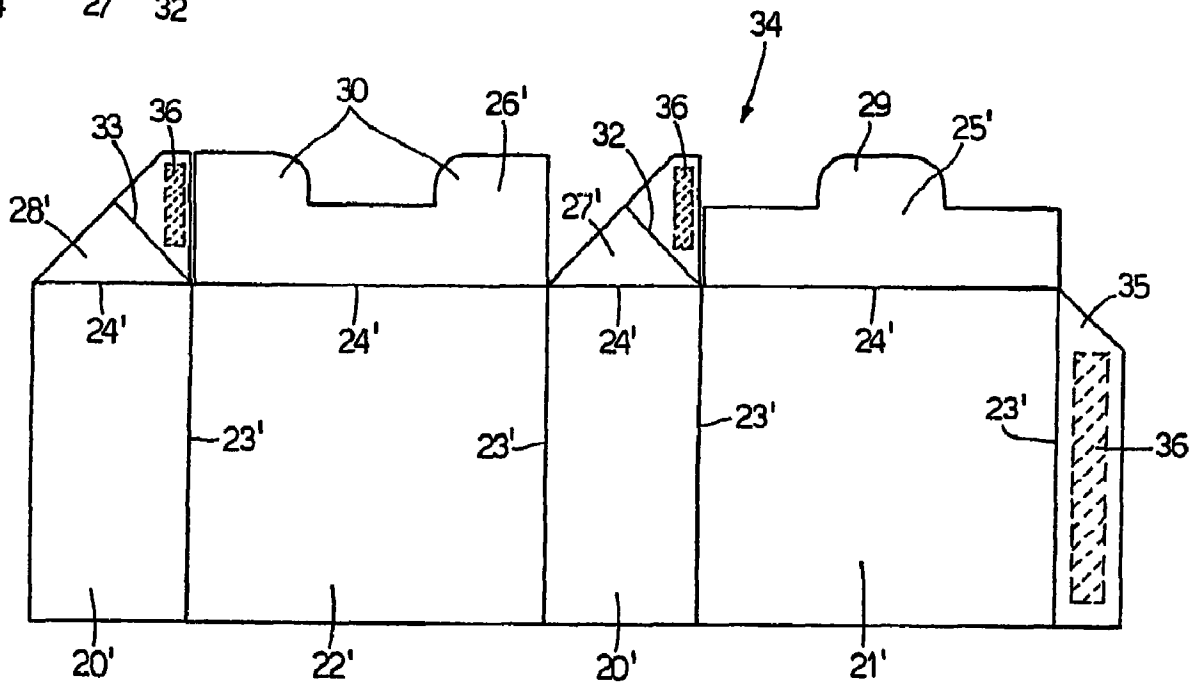
FIG. 8 shows a layout of a blank from which to form the FIG. 4 bottom shell.

As shown in FIG. 8, bottom shell 4 is formed from a corresponding flat blank 34, which is substantially in the form of an elongated rectangle, and the component parts of which are indicated, where possible, using the same reference numbers, with superscripts, as for the corresponding component parts of bottom shell 4.

From left to right, blank 34 comprises a portion 20' corresponding to a minor lateral wall 20; a portion 22' corresponding to rear wall 22; a further portion 20' corresponding to the other minor lateral wall 20; a portion 21' corresponding to front wall 21; and a tab 35. Portions 20', 21', 22' and tab 35 are separated by preformed fold lines 23' eventually defining longitudinal edges 23 of bottom shell 4.

Portions 20' are connected to portions 27' and 28', which correspond to panels 27 and 28 and are separated from portions 20' by preformed fold lines 24' eventually defining minor transverse edges 24 of bottom shell 4; portions 21' and 22' are connected to portions 25' and 26', which correspond to panels 25 and 26 and are separated from portions 21' and 22' by preformed fold lines 24' eventually defining major transverse edges 24 of bottom shell 4. When forming bottom shell 4, tab 35 is superimposed on and gummed to the opposite portion 20', and portions 27' and 28' are superimposed on and gummed to portions 25' and 26'. The gummed portions 36, on which gum is preferably deposited, are shown by way of reference.

In an alternative embodiment not shown, as opposed to a bottom shell, foldable protective member 4 is in the form of a tubular member open at both ends, i.e. is identical to the one shown in the accompanying drawings, except that it has no end wall 19.

In a further embodiment not shown, protective member 4 has fastening means for fastening protective member 4 in position with respect to packet 2, when packet 2 is inserted inside protective member 4. More specifically, the fastening means may comprise projections formed inside protective member 4, and seats for receiving said projections and formed on the outer surface of packet 2.

Given the numerous advantages of package 1 of cigarettes as described above, the characteristics of package 1, and in particular the provision of bottom shell 4, may also be applied integrally to a carton of cigarettes containing a group of packets of cigarettes as opposed to group 3 of cigarettes.

A further point to note is that at least one of the exposed lateral surfaces of protective member 4 may be printed with wording and/or graphics of any type, so that protective member 4 may also perform the same function usually performed by coupons attached to containers of tobacco items.

The invention claimed is:

1. A package of tobacco items comprising:

a parallelepiped-shaped packet (2) of tobacco items, which opens at a top and houses a group (3) of tobacco items, and a hollow parallelepiped-shaped protective member (4) which is able to house a portion of the packet (2) of tobacco items with substantially no clearance, is foldable, can assume indifferently a closed configuration, in which it is tubular and flat, and an open configuration, in which it has a hollow parallelepiped tubular shape to house a portion of the packet (2) of tobacco items with substantially no clearance;

wherein the protective member (4) comprises four flat panels (20', 21', 22') bounded by folding lines (23'), which define edges (23) of the hollow protective member (4) in the open configuration; for changing from the open configuration to the closed configuration and vice versa, the flat panels being rotated one with respect to the other about the folding lines (23'); protective member (4) being folded into the closed configuration and attached removably to the packet (2) of tobacco items, wherein the protective member (4) in the closed configuration is inserted inside the packet (2) of tobacco items.

2. A package as claimed in claim 1, characterized in that the packet (2) comprises two, respectively top and bottom, end walls (9, 10); a lateral surface (8) bounded by the end walls (9, 10) and defined by two, respectively front and rear, major lateral walls (12, 13), and by two minor lateral walls (11); four longitudinal edges (15), each defined between a major lateral wall (12; 13) and a minor lateral wall (11); and eight transverse edges (16), each defined between an end wall (9; 10) and a lateral wall (11; 12; 13); the protective member (4) in the open configuration being parallelepiped-shaped, and comprising a lateral surface (17) defined by two, respectively front and rear, major lateral walls (21, 22), and by two minor lateral walls (20); each major lateral wall (21; 22) of the protective member (4) being substantially the same width as and smaller in height than the major lateral walls (12, 13) of the packet (2) of tobacco items; and each minor lateral wall (20) of the protective member (4) being substantially the same width as and smaller in height than the minor lateral walls (11) of the packet (2) of tobacco items.

3. A package as claimed in claim 2, characterized in that, to switch from the closed configuration to the open configuration, the minor lateral walls (20) of the protective member (4) are rotated, with respect to the major lateral walls (21, 22) of the protective member (4), about the longitudinal edges (23) between the minor lateral walls (20) and major lateral walls (21, 22) of the protective member.

4. A package as claimed in claim 3, characterized in that each major lateral wall (21; 22) of the protective member (4) is smaller in height than the width of the major lateral walls (12, 13) of the packet (2) of tobacco items.

5. A package as claimed in claim 2, characterized in that the protective member (4) is defined by a foldable bottom shell (4), which may assume a closed configuration, in which it is flat, and an open configuration, in which it is in the form of a box for housing a bottom portion of the packet (2) of tobacco items with substantially no clearance.

6. A package as claimed in claim 5, characterized in that the bottom shell (4) comprises a bottom end wall (19) of substantially the same size as the bottom end wall (10) of the packet (2) of tobacco items.

7. A package as claimed in claim 6, characterized in that the bottom end wall (19) of the bottom shell (4) is defined by a single panel (31) connected to only one lateral wall (20; 21; 22) of the bottom shell (4) along a respective transverse edge.

8. A package as claimed in claim 7, characterized in that the bottom end wall (19) of the bottom shell (4) comprises fastening means for fixing the bottom end wall (19) to the lateral wall (20; 21; 22) of the bottom shell (4) opposite the lateral wall (20; 21; 22) of the bottom shell (4) connected to the bottom end wall (19) along the respective transverse edge (24).

9. A package as claimed in claim 8, characterized in that the fastening means comprise a tongue integral with the bottom end wall (19) of the bottom shell (4); and a slit for receiving the tongue and formed in the lateral wall (20; 21; 22) of the bottom shell (4).

10. A package as claimed in claim 6, characterized in that the bottom end wall (19) of the bottom shell (4) is defined by two first panels (25, 26), each connected to a respective lateral wall (20; 21; 22) of the bottom shell (4) along a respective transverse edge (24).

11. A package as claimed in claim 10, characterized in that the bottom end wall (19) of the bottom shell (4) is defined by two second panels (27, 28), each connected to a respective minor lateral wall (20) and to a respective major lateral wall (21; 22) of the bottom shell (4) along respective transverse edges (24); the second panels (27, 28) being located below the first panels (25, 26), so that the first panels (25, 26) rest on the second panels (27, 28) when the bottom shell (4) is in the open configuration.

12. A package as claimed in claim 11, characterized in that, to fold up when the bottom shell (4) is in the closed configuration, each second panel (27; 28) has a respective preformed fold line (32; 33) extending across the whole of the second panel (27, 28) and originating at the point of intersection between a major transverse edge (24) and a minor transverse edge (24).

13. A package as claimed in claim 11, characterized in that the first panels (25, 26) comprise respective complementary-shaped appendixes (29, 30), so that the appendixes (29; 30) of one first panel (25; 26) rest on the other first panel (26; 25), and vice versa, when the bottom shell (4) is in the open configuration.

14. A package as claimed in claim 2, characterized in that the longitudinal edges (23) and transverse edges (24) of the protective member (4) in the open configuration are substantially the same shape as the longitudinal edges (15) and transverse edges (16) of the packet (2) of tobacco items.

15. A package as claimed in claim 1, characterized by comprising fastening means for fastening the protective member (4) in position with respect to the packet (2) of tobacco items, when the packet (2) of tobacco items is inserted inside the protective member (4).

16. A package as claimed in claim 1, characterized in that at least one of the exposed lateral surfaces of said protective member (4) is printed with wording or graphics.

* * * * *